United States Patent [19]

Komatsu et al.

[11] 4,230,751

[45] Oct. 28, 1980

[54] TREATING COMPOSITION, FORMING A MIXED-CARBIDE LAYER OF VA-GROUP ELEMENTS AND OF CHROMIUM ON A FERROUS-ALLOY SURFACE AND RESULTING PRODUCT

[75] Inventors: Noboru Komatsu; Tohru Arai, both of Toyoake; Hironori Fujita, Aichi, all of Japan

[73] Assignees: Kabushiki Kaisha Toyota, Nagoya; Chuo Kenkyusho, Aichi, both of Japan

[21] Appl. No.: 931,953

[22] Filed: Aug. 8, 1978

[30] Foreign Application Priority Data

Aug. 11, 1977 [JP] Japan ..... 52-95571

[51] Int. Cl.[2] ..... C23C 9/16; C25D 3/66; B32B 15/18

[52] U.S. Cl. ..... 427/443.1; 106/1.22; 106/1.25; 148/6.11; 252/184; 204/39; 427/431; 428/472; 428/539

[58] Field of Search ..... 106/1.22, 1.25; 252/184; 427/430 A, 431; 428/472, 409, 539; 204/39; 148/6.11

[56] References Cited

U.S. PATENT DOCUMENTS

| | | | |
|---|---|---|---|
| 2,786,809 | 3/1957 | Raynes | 204/39 |
| 2,827,400 | 3/1958 | Eisenberg et al. | 106/1.22 X |
| 2,950,233 | 8/1960 | Steinberg et al. | 204/39 X |
| 2,957,782 | 10/1960 | Boller | 204/39 X |
| 3,600,284 | 8/1971 | Martinez | 204/39 X |
| 3,671,297 | 6/1972 | Komatsu et al. | 427/431 |
| 3,887,443 | 6/1975 | Komatsu et al. | 204/39 |
| 3,912,827 | 10/1975 | Komatsu et al. | 204/39 X |
| 3,930,060 | 12/1975 | Komatsu et al. | 148/6.11 X |
| 3,959,092 | 5/1976 | Komatsu et al. | 204/39 |
| 3,979,267 | 9/1976 | Townsend | 204/39 X |
| 4,009,086 | 2/1977 | Komatsu et al. | 204/39 |
| 4,158,578 | 6/1979 | Komatsu et al. | 427/431 X |

*Primary Examiner*—Harold Ansher

*Attorney, Agent, or Firm*—Berman, Aisenberg & Platt

[57] ABSTRACT

A method and treating material are presented for forming a mixed-carbide layer of at least one Va-Group element and of chromium on the surface of a carbon-containing ferrous-alloy material. A molten treating bath is prepared by introducing one or more Va-Group elements in oxide form and chromium in metal or alloy form or by introducing one or more Va-Group elements in metal or alloy form and at least one chromium oxide into a molten bath composed of boric acid, of at least one borate or of a mixture thereof. An article of carbon-containing ferrous alloy is immersed and maintained in the molten treating bath until a mixed-carbide layer is formed on its surface. The mixed-carbide layer formed on the surface of the article is very smooth, wear resistant and high-temperature-oxidation resistant.

38 Claims, 7 Drawing Figures

(X 400)

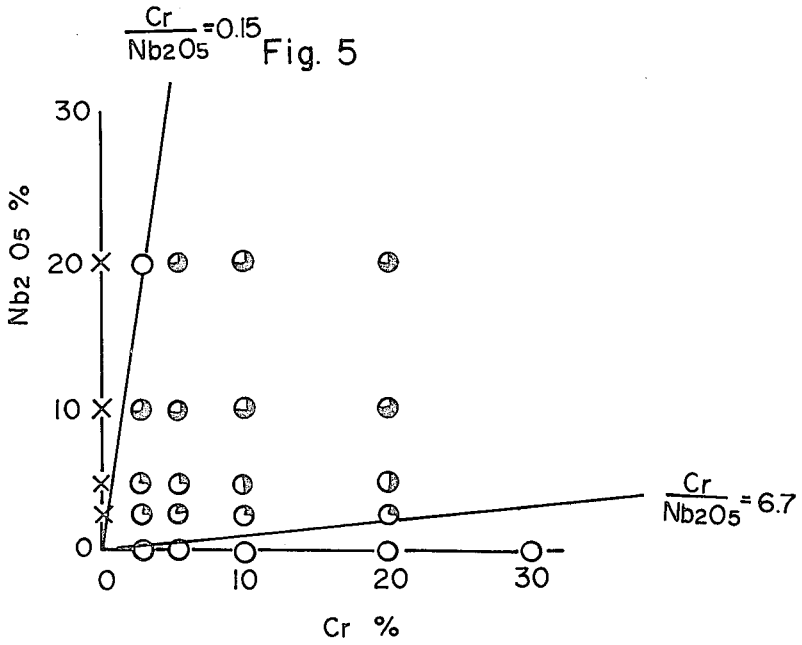
Fig. 6
(X400)
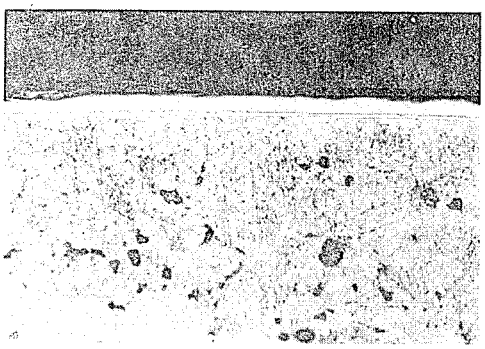

Cr / Ta2O5 = 0.15

20
10
0
Ta2O5 %
0
10
20
Cr %
Cr / Ta2O5 = 6.7

TREATING COMPOSITION, FORMING A MIXED-CARBIDE LAYER OF Va-GROUP ELEMENTS AND OF CHROMIUM ON A FERROUS-ALLOY SURFACE AND RESULTING PRODUCT

BACKGROUND

A ferrous-alloy article having a surface carbide layer of at least one Va-Group element, such as a vanadium-carbide, a niobium-carbide or a tantalum carbide surface layer, has excellent wear resistance, but poor oxidation resistance. A corresponding alloy article having a chromium carbide surface layer has excellent high-temperature-oxidation resistance and is thus useful, e.g., for a metal mold which is subjected to high temperatures; however, the chromium-carbide layer is inferior in wear resistance to that of a carbide of a Va-Group element.

On surfaces of hot-forging molds, casting-metal molds, glass-forming metal molds, parts of a forging machine, parts of glass-forming machines and the like, which are ordinarily used at high temperatures and are subject to wear-resistance problems, a chromium layer is often formed by a diffusion treatment called chromizing. The most practical surface layer formed on steel is a chromium-carbide layer. As indicated, a chromium-carbide layer has sufficient performance with regard to high-temperature-oxidation resistance but is deficient in wear resistance.

After intensive work a way was devised to impart temperature-oxidation resistance and wear resistance to a ferrous-alloy article.

By forming a mixed-carbide layer of one or more Va-Group elements and of chromium on a ferrous-alloy article surface, the combined merits of both individual carbide layers are imparted to the surface.

To form a mixed-carbide layer on a ferrous-alloy article, immersing and keeping the ferrous-alloy article in a molten borate bath, to which chromium (in the form of pure metal or alloy) powder and powder of one or more Va-Group elements (in the form of pure metal or alloy) are added, is proposed by U.S. Pat. No. 3,671,297. This method is useful but has the following drawbacks:

(1) The metal powders added to the molten borate bath tend to build up at the bottom of the vessel in which the bath is contained. When an article to be treated is immersed in the bath and contacts collected metal powder, some metal powder adheres to the surface of the article, impairing the surface condition of the article. To minimize this, great care must be taken in the dipping of the article to be treated into the bath.

(2) Because of the noted powder buildup, the effective bath volume into which an article to be treated can be introduced is limited, and productivity is continually reduced.

(3) Since particles of the built-up metal powders tend to be sintered with each other in a grain, the effective surface area of the particles is reduced sufficiently to impair and even prevent solution of carbide-forming elements, such as chromium and Va-Group elements, in molten borax. In order to counteract this defect to some extent, it is necessary to stir up the bottom part of the bath-containing vessel from time to time. This necessitates considerable work. (4) When particles of metal powders contact the surface of an article being treated, the particles adhere to and impair the surface condition of the article.

(5) When a large amount of metal powder is added to a salt bath, the viscosity of the bath is increased. The amount of treating material which attaches itself to a treated article and is thus removed from the bath with the article is similarly increased. This reduces bath volume and results in more interruptions for additional bath make-up.

(6) An increase in salt-bath viscosity reduces the fluid character of and the convection flow in the molten treating bath and results in reducing the uniformity in temperature distribution throughout the bath. This further limits the effective volume of the bath-containing vessel.

SUMMARY OF THE INVENTION

The present invention has several distinct, but closely interrelated, aspects:

(a) treating bath compositions,
(b) molten treating baths,
(c) forming a mixed carbide layer of at least one Va-Group element and of chromium on the surface of a carbon-containing ferrous-alloy article, and
(d) a carbon-containing ferrous-alloy article having a mixed carbide layer of at least one Va-Group element and of chromium on its surface.

An article of a ferrous alloy (having at least 0.1 percent by weight of carbon in its composition) is immersed in a molten treating bath [of molten boric acid, of at least one borate or of a mixture thereof and comprising: (1) one or more Va-Group elements in oxide form and chromium in metal or alloy form or (2) one or more Va-Group elements in metal or alloy form and at least one chromium oxide] and maintained therein for a period of time sufficient to form a mixed-carbide layer of at least one Va-Group element and of chromium on the surface of the article.

OBJECTS

An object of the present invention is to provide an improved method for forming a mixed-carbide layer of chromium and of Va-Group element on the surface of a ferrous-alloy article for the purpose of overcoming previously-noted defects. The gist of the present invention may be regarded to reside in a method for forming a mixed-carbide layer of one or more Va-Group elements and of chromium on a ferrous-alloy-article surface. The method is characterized by the ferrous-alloy article, which comprises at least 0.1 percent by weight of carbon, and by immersing and keeping such article in a molten borate and/or boric acid bath which contains (a) chromium oxide and one or more Va-Group elements in powdered metal or powdered alloy form or (b) chromium powder in metal or alloy form and of one or more Va-Group elements in powdered oxide form.

Another object of the present invention is to provide a method for forming a covering layer, which has oxidation resistance and wear resistance at high temperatures, on surfaces of a ferrous-alloy article. This object is achieved by forming on such surfaces a mixed-carbide layer of one or more Va-Group elements and of chromium.

A further object of this invention is to provide a method for forming on a ferrous-alloy article a mixed-carbide layer with denseness (lack of porosity) and uniformity and without any undissolved treating-metal particles adhered to the surface of the article.

A still further object of this invention is to provide a molten treating bath which is capable of forming on a ferrous-alloy article a mixed-carbide layer having a smooth surface.

An additional object of this invention is to provide a method for forming a mixed-carbide layer of one or more Va-Group elements and of chromium which has the merits of each of the single-carbide layers of the respective elements.

Another object is to provide a ferrous-alloy article having a smooth surface with the wear resistance of a Va-Group element carbide layer and the high-temperature-oxidation resistance of a chromium carbide layer.

Other objects of this invention will appear hereinafter.

RELATED APPLICATIONS

This application is directed to subject matter which is related to that disclosed in application Ser. No. 902,696, filed on May 4, 1978, and to that disclosed in application Ser. No. 921,794, filed July 3, 1978. The entire disclosure of both of these related applications is incorporated herein by reference.

BRIEF DESCRIPTION OF THE DRAWINGS

FIG. 5 shows the relation between the composition of the treating bath and the form carbide surface layer according to Example 4.

FIG. 6 shows a photomicrograph of the cross-section of a test piece treated in Example 4.

DEFINITIONS

Figure 1:
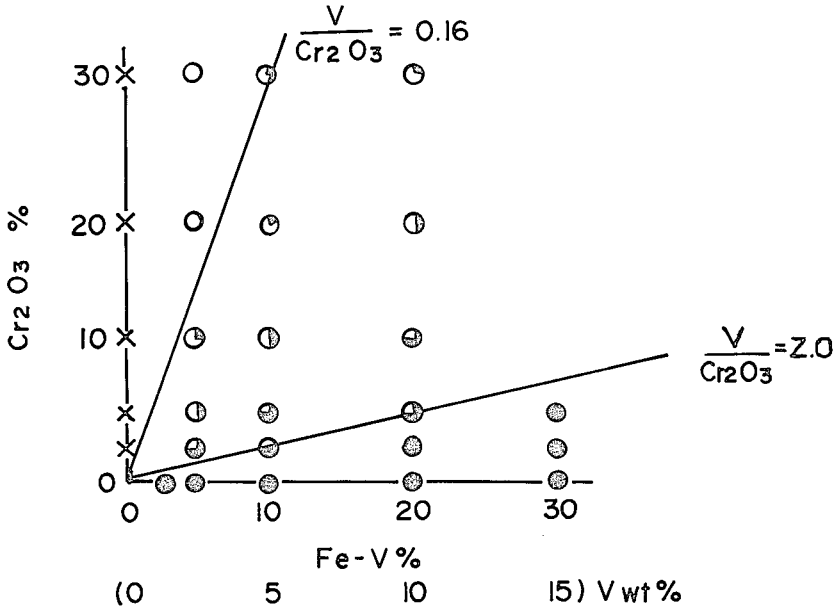
FIG. 1 shows the relation between the composition of the treating bath and the formed carbide surface layer according to Example 1, infra.

Throughout the specification and claims a number of terms are used in substantially the same way. To assist in the understanding of some of these terms and in the interpretation of the relevant text, the following definitions are provided. Each designated term is to be accorded the assigned definition in the absence of an express indication to the contrary.

alloy or alloy form—for ferrous alloy, see subsequent definition; for chromium, any chromium-containing alloy (e.g. nichrome and stellite) is suitable, but those having at least 20 weight percent (e.g. cast irons) and preferably at least 40 weight percent (e.g. ferro-chromium with from 62 to 71 percent chromium) of chromium are more conveniently employed; for Va-Group elements, any alloy is suitable, but preference is accorded those with at least 20 weight percent and advantageously at least 40 weight percent of the subject element, cf. ferro-niobium, ferro-tantalum and ferro-vanadium; other suitable alloys of niobium and tantalum, e.g., include those with tungsten.

alloy steel—steel containing at least 0.10 weight percent of carbon, e.g. standard engineering steels, such as SAE No. C 1012 (0.10 to 0.15 percent carbon), SAE No. A 2317 (0.15 to 0.20 percent carbon), SAE No. A 3140 (0.38 to 0.43 percent carbon), SAE No. A 9262 (O.53 to 0.65 percent carbon), SAE No. A 4067 (0.64 to 0.72 percent carbon) and SAE No. E 52101 (0.95 to 1.10 percent carbon).

borate—includes every borate which is in molten state and stable (does not decompose) at some temperature within the bath-temperature range of from about 850° to about 1100° C., preferably an alkali-metal borate, such as a sodium borate (e.g. $Na_2B_4O_7$ and $NaBO_2$) or a potassium borate (e.g. $KBO_2$ and $KB_5O_8$). As is obvious to any artisan, the borate, e.g, borax, is in anhydrous form (in view of the bath temperature) to avoid sputtering, bubbling or spilling.

carbon steel—cf. alloy steel.

carbon tool steel—any carbon steel having tool-steel quality and characteristics, such as JIS SK4 (Japanese Industrial Standard SK 4).

chromium oxide—each and every oxide of chromium, e.g. $Cr_2O_3$, which does not decompose at a temperature below about 850° C.

critical elements—each of the Va-Group elements and chromium (Cr).

electric current density—see U.S. Pat. No. 3,887,443 electrolysis—separation of ions of an electrolyte by an electric current.

ferro-niobium—an alloy of iron and niobium advantageously having at least 20 weight percent and preferably having at least 40 weight percent of niobium.

ferro-tantalum—a ferroalloy of iron and tantalum advantageously having at least 20 weight percent and preferably having at least 40 weight percent of tantalum.

ferrous alloy—an iron alloy containing at least 0.10 weight percent of carbon; cf. alloy steel.

ferro-vanadium—a ferroalloy of iron and vanadium advantageously having at least 20 weight percent (e.g. high-carbon ferror-vanadium with from 30 to 40 percent vanadium) and preferably having at least 40 weight percent of vanadium.

high-temperature-oxidation resistance, excellent—e.g. the present invention can be used as hot-forging molds for iron or steel or as glass-forming molds.

mesh—based on the Tyler Standard Screen-Scale Sieve standards.

metal or metal form—refers to chromium or a Va-Group element in free-metal (zero valence) form other than in the form of an alloy with one or more other metals.

mixed-carbide layer—a surface layer of chromium carbide and of a carbide of at least one Va-Group element on a ferrous alloy, the carbide being at least partially provided by carbon in the composition of the ferrous alloy. The mixed carbide layer appears either in only one layer or in two layers.

molten treating bath—a molten composition of molten boric acid and/or of at least one molten borate in which is incorporated at least one metal and/or alloy and at least one oxide, the metal and/or alloy being that of one or more Va-Group elements when the oxide comprises at least one chromium oxide and being that of chromium when the oxide comprises one or more Va-Group elements in oxide form, the metal and/or alloy comprising from about 1 to about 35 or 40 weight percent of the composition and the oxide comprising from about 1 to about 35 or 40 weight percent of the composition.

oxide or oxide form—for chromium, cf. chromium oxide; for Va-Group elements, each and every oxide of any such element which does not decompose at a temperature below about 850° C.; for niobium, e.g. $Nb_2O_5$, $Nb_2O_3$, $NbO_2$ and NBO; for tantalum, e.g. $Ta_2O_5$, $Ta_2O_3$ and $Ta_2O_2$; for vanadium, e.g. $V_2O_5$, $V_2O_3$, $VO_2$ and VO.

potassium borate—cf. borate.

powder—a solid in particulate form, substantially all particles of which pass a 100-mesh screen; usually from −100 to −350 mesh.

smooth surface—the surface of the formed layer has the same smoothness as the surface of untreated mother material; metal power does not remain on the surface of the formed layer.

sodium borate—cf. borate.

Va-Group element—an element, such as niobium (Nb), tantalum (Ta) and vanadium (V), of the Va-Group of the Periodic Table.

wear resistance, excellent—the degree of abrasion of the present invention is less than about 1/25 that of SKD1(AISID3).

DETAILS

An essential ingredient of a molten bath used in the present invention is boric acid and/or at least one borate. This is the same as that which was known and used in the art for forming a carbide layer. In this description borax, which is regarded as most practical, is used in the actual working examples, but it is readily replaced by one or more borates and/or by boric acid without significantly altering the procedure or results.

In addition to the boric acid and/or borate, which are maintained in molten form, two further ingredents are required as additives to prepare the molten treating bath. One of these ingredients is chromium, and the other is at least one Va-Group element. Of the particular elements which comprise these two further ingredients, at least one must be in oxide form and at least one must be in free-metal or in alloy form. It is convenient to use chromium in oxide form when at least one Va-Group element is in metal or alloy form and to use chromium in metal or alloy form when at least one Va-Group metal is in oxide form. When two different Va-Group elements (one in oxide form, e.g. $Ta_2O_5$, and one in metal or alloy, e.g. ferro-vanadium having about 50 weight percent of vanadium, form) are incorporated in the molten boric acid and/or borate bath, added chromium is optionally in oxide form or in metal or alloy form.

The oxides, metals and alloys are solids. Since the metals and alloys are not readily soluble in molten boric acid and/or molten borate, they should be incorporated therein in powder form or, possibly, in flake form. As the oxides are more soluble in the molten bath, flake form is more suitable for them, but powder form is still preferred.

The minimum amount of compounded metal or alloy additive is 1 percent by weight and that of oxide is also 1 percent by weight. The maximum amount of compounded metal or alloy additive is from 35 to 40 percent by weight and that of oxide is also from 35 to 40 percent by weight (leaving only from 20 to 30 percent by weight of boric acid and/or of borate). For the purpose of these percentages the entire amount of the metal, the alloy or the oxide is counted.

There is a reason that at least one of the critical elements must be in oxide form and at least one must be in metal or alloy form. When a ferrous-alloy article is immersed in a molten-borate (and or boric acid) bath to which oxides of chromium and of Va-Group elements are added, a carbide layer is not formed on the article. To form a carbide layer on the article in a molten borate bath containing only a chromium oxide or an oxide of a Va-Group element, it is necessary to reduce (by electrolysis or by adding a reducing material together with the additive) the oxides and thus produce a carbide-layer-forming element. When a ferrous-alloy article is immersed in a molten borate (and/or boric acid) bath to which chromium and at least one Va-Group element are added in metal or alloy form, difficulty is encountered since the metal or alloy form lacks the requisite solubility and tends to impair the surface of the article.

With regard to the present invention, the metal or alloy added together with the oxide acts to reduce the oxide as indicated by the following chemical equation:

$$3V_2O_5 + 10Cr \rightarrow 6V + 5Cr_2O_3 \quad (1)$$

The free energy change, ΔG, determines whether the reduction reaction advances or not. When the value of ΔG is minus, the reaction advances (i.e. the reduction takes place). When ΔG is plus, the reaction does not advance and the reduction is not carried out.

Although it thus appears that it can be readily determined, without experimentation, whether a particular reduction reaction will take place if the ΔG value is available from well-known thermodynamic constants, such is not the case.

For example, with regard to the mixed carbide of Cr and V, the combination of vanadium oxide powder and chromium metal powder makes ΔG for the equation (1) minus. Therefore, the reduced V and the Cr which is not used for the reduction form the desired mixed carbide. On the other hand, in a similar bath to which a chromium oxide powder and vanadium metal powder are added, ΔG of the reaction:

$$5Cr_2O_3 + 6V \rightarrow 10Cr + 3V_2O_5 \quad (2)$$

is plus. Therefore, it would appear that only a vanadium carbide layer might form because reduction of $Cr_2O_3$ will not occur. However, experiments confirm that a mixed-carbide layer of Cr and V is clearly formed.

A possible explanation of this phenomenon is that $V_2O_5$ and/or $Cr_2O_3$ might change to oxides of other types in the borate bath. The precise constitution of the molten salt bath is not certain. Therefore, it is not possible to predict from the value of the free energy change, ΔG, alone whether a mixed-carbide layer will be formed according to the present invention.

Formation of a mixed-carbide layer on a ferrous-alloy article surface also depends on a number of other factors, including the nature of the ferrous alloy and the requirement that it contain at least 0.10 percent by weight of carbon.

The mixed-carbide layer is conveniently formed on such a ferrous-alloy article by immersing the article in a molten borate or boric acid bath containing chromium and at least one Va-Group element in suitable form.

Dissolving chromium or a Va-Group (in metal or alloy form) in the molten bath is somewhat facilitated by concurrently incorporating in the same bath one or more oxides (of the Va-Group element or of chromium, respectively). By having the Va-Group element or chromium (in metal or alloy form) as a finely-divided powder (particle size, e.g., from −100 to −325 mesh), solution is further assisted.

When the Va-Group element is in metal form or in alloy form, e.g., as ferro-niobium (Fe-Nb), ferro-tantalum (Fe-Ta) or ferro-vanadium (Fe-V), the weight ratio of the Va-Group element in such form to chromium oxide incorporated in the molten treating bath is preferably in the range of from 0.16 to 3.3. For what is nominally a 5 kilogram molten treating bath (excluding nonessential alloying metals), illustrative bath additions are: 0.5 kg of Nb, 0.5 kg of Fe-V (50% V), 0.5 kg of Ta, 0.5 kg of V, 0.5 kg of Fe-Ta (50% Ta) and 1.5 kg of Fe-Nb (50% Nb) for 0.25, 0.13, 0.25, 1.0, 1.0 and 1.25 kg, respectively, of chromium oxide ($Cr_2O_3$). When vanadium is the Va-Group element and it is added in the form of Fe-V, the weight ratio of vanadium in the Fe-V to chromium oxide is preferaby in the range of from 0.16 to 2.0. When niobium is the Va-Group element and it is incorporated in the molten bath in the form of Fe-Nb, the weight ratio of the niobium in the Fe-Nb to chromium oxide is preferably in the range of from 0.5 to 3.3.

When the Va-Group element is in oxide form and chromium is incorporated in the molten bath in free-metal or in alloy form, the weight ratio of chromium to oxide (of the Va-Group element) is preferably in the range of from 0.15 to 6.7. When chromium is in metal form and the oxide is a vanadium oxide, the weight ratio of chromium to vanadium oxide is preferably within the range of from 0.80 to 2.0. For a 5 kilogram molten treating bath, illustrative bath additions are: 0.25 kg of NbO, 0.25 kg of $VO_2$, 0.5 kg of $V_2O_5$, 0.25 kg of $NbO_2$, 0.5 kg of $Ta_2O_5$ and 0.25 kg of $Nb_2O_5$ for 0.5, 0.75, 0.5, 0.75, 1.0 and 1.5 kg, respectively, in metal or alloy form of chromium.

Exemplary make-up components for 5-kilogram molten treating baths are presented in Table 1. Each of the thirty treatment-bath formulations is compounded by melting the boric acid and/or borate components in a suitable vessel and incorporating the oxide and the element components in the resulting melt. The element and oxide components are preferably in powder form when added to the melt. When an element is incorporated in the melt in alloy form, the actual amount of alloy used must be increased sufficiently to provide the resulting melt with the indicated quantity of the element.

The molten medium for the treating bath is provided by boric acid or a borate or any suitable mixture. Alkali metal borates are conveniently used or this purpose, particularly borax.

When chromium or one or more Va-Group elements are introduced into the molten bath, they are generally in particulate, e.g. powder, or flake form. A Va-Group element or chromium in metal or alloy form is preferably introduced into a molten bath as a fine powder, i.e. having a particle size finer than 100 mesh.

TABLE I

BATH COMPOSITIONS (kilograms)

| Ingredient | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| V | 0.25 | | | | | | | | | | | | 0.50 | | |
| Ta | | 0.50 | | | | | | | | 0.25 | | | | 0.75 | |
| Nb | | | 0.50 | | | | | | | | | | | | 0.75 |
| Cr | | | | 0.5 | 1.0 | 1.5 | 0.75 | 1.5 | 0.75 | 0.50 | 0.25 | 0.5 | | | |
| $Cr_2O_3$ | 0.13 | 0.25 | 1.0 | | | | | | | | | | 1.0 | 0.5 | 1.25 |
| $V_2O_5$ | | | | 0.5 | | | | | | | | | | | |
| $VO_2$ | | | | | | | 0.25 | | | | | | | | |
| $Ta_2O_5$ | | | | | 0.5 | | | 0.5 | | 0.50 | 0.75 | | | | |
| $Nb_2O_5$ | | | | | | 0.25 | | | | | | | | | |
| $NbO_2$ | | | | | | | | | 0.25 | | | | | | |
| NbO | | | | | | | | | | | | 0.25 | | | |
| $Na_2B_8O_{13}$ | 2.00 | | | | | | | | | | | | | | |
| $Na_2B_6O_{10}$ | | | | | | 1.25 | | | | | | | | 3.75 | |
| $Na_2B_4O_7$ | 2.62 | 4.25 | | | 2.0 | | | 1.5 | | 3.75 | 2.8 | 2.0 | | | |
| $Na_2B_2O_4$ | | | 3.50 | | | 2.0 | | | | | | | 3.0 | | |
| $K_2B_4O_7$ | | | | | 1.5 | | | 2.5 | | | | 2.25 | | | |
| $Li_2B_4O_7$ | | | | 4.0 | | | 4.0 | | | | | | 0.50 | | 3.0 |
| $CaB_4O_7$ | | | | | | | | | 4.0 | | 1.2 | | | | |

| Ingredient | 16 | 17 | 18 | 19 | 20 | 21 | 22 | 23 | 24 | 25 | 26 | 27 | 28 | 29 | 30 |
|---|---|---|---|---|---|---|---|---|---|---|---|---|---|---|---|
| V | 0.25 | | | 0.5 | | | 0.5 | | | | | | | | |
| Ta | | 0.5 | | 0.25 | 0.25 | 0.5 | | | | | | | | | |
| Nb | | | 0.75 | | 0.50 | 0.25 | 0.25 | | | | | | | | |
| Cr | | | | | | | | 0.75 | 0.25 | 0.75 | 0.25 | 1.0 | 0.75 | 0.50 | 1.0 |
| $Cr_2O_3$ | 0.5 | 1.0 | 0.5 | 0.5 | 0.75 | 0.75 | 0.75 | | | | | | | | |
| $V_2O_5$ | | | | | | | | 0.50 | | | | | | | |
| $VO_2$ | | | | | | | | | 0.50 | | | | | | |
| $Ta_2O_5$ | | | | | | | | | | 0.50 | | | | | |
| $Nb_2O_5$ | | | | | | | | | | | | 0.25 | | | |
| $NbO_2$ | | | | | | | | | | | | | 0.50 | | 0.50 |
| NbO | | | | | | | | | | | 0.50 | 0.50 | 0.25 | 0.50 | |
| $Na_2B_8O_{13}$ | 4.25 | | | | | | | | | | | | | | |
| $Na_2B_6O_{10}$ | | 2.0 | | | | 3.5 | | | | | 2.0 | | | | |
| $Na_2B_4O_7$ | | | | 3.75 | | | | 3.75 | 4.25 | 1.75 | | 3.25 | 2.0 | | |
| $Na_2B_2O_4$ | | | | | 2.0 | | | | | | | | | | |
| $K_2B_4O_7$ | | 1.5 | | | | | | | | 2.0 | 2.25 | | 1.50 | 2.0 | 1.5 |
| $Li_2B_4O_7$ | | | | | 1.5 | | 3.5 | | | | | | | 2.0 | |
| $CaB_4O_7$ | | | 3.75 | | | | | | | | | | | | 2.0 |

The present invention aims to promoting the dissolution of additives in the molten borate bath by using one of the carbide-forming elements in oxide form. It is also directed to the industrially preferable formation of a mixed carbide layer.

Further, the addition of one or more oxides of a Va-Group element and/or of chromium remarkably improves the fluidity of the borate bath and overcomes defects, such as an increase in wasted bath material which might otherwise be removed from the bath by adherence to treated articles, reducing convection by high viscosity and decreasing the effective volume of a vessel by reducing the uniformity in temperature distribution, caused by the exclusive addition of metal powder to the bath. Furthermore, the present invention lengthens the life of the salt bath by making it possible to incorporate more metal powder therein. The improvement in fluidity attained by the addition of oxides may be caused by the ready dissolution of such oxides and also of oxide formed by the reaction of metal powder with added oxide. The improvement in bath fluidity attained by incorporating oxides therein lowers the bath temperature at which treatment is suitably effected. In this case, the difficulty caused by lowering the fluidity of the bath can be overcome.

To overcome defects caused by incorporating only metal powder in a borate bath, a method is employed in which a reducing agent (for reducing oxides), such as silicon, aluminum, calcium, titanium or manganese, is added together with oxides. This method can form a mixed carbide layer but incurs the following defects. It is difficult to control the make-up of the bath because of the complexity of the bath composition, and several further problems are caused by the reducing agent. For example, when Fe-Al (ferro-aluminum) is used as reducing agent, the Fe-Al attaches to the surface of a treated article and impairs the smoothness and contour of such surface. When silicon or calcium is the reducing agent, it takes considerable time to wash treated articles because the borate (including silicon and/or calcium) is not easily dissolved. Also, reducing agents preferentially reduce the oxide which is more reducible than another, and the formed carbide layer is composed mainly of the Va-Group element of the reduced oxide. Therefore, continuous or steady formation of a mixed carbide layer having a predetermined composition is very difficult. A further drawback is that the composition of any formed mixed carbide layer is apt to change with time. The present invention overcomes these defects.

The composition ratios of the oxide powder and of the metal powder, which are incorporated in the borate bath according to the present invention, vary over a considerable range according to the kind of oxide and are not properly limited to specific values. The actual component ratios employed should be decided by a trial experiment preceding any industrial run. However, as a general rule, increasing the ratio of the metal powder to the oxide powder increases the ratio of the element of the metal powder which is contained in the formed mixed-carbide layer.

The carbon content of the ferrous alloy treated according to the present invention should be more than 0.10 percent by weight. When a ferrous alloy having a lower carbon content is similarly treated, the formed mixed carbide layer is thin and the predetermined aim is not attained. The carbon content of the ferrous alloy also greatly affects the velocity of layer formation and the final thickness of the formed mixed-carbide layer. Elements other than carbon in the ferrous alloy do not greatly affect the formation of the mixed-carbide layer.

According to the present invention, by immersing and keeping a ferrous alloy article (having a carbon content of more than 0.10 percent by weight) in a molten borate bath (having a temperature in the range of from 850° to 1100° C.) in which chromium and one or more Va-Group elements (at least one as the oxide powder and at least one as metal or alloy powder) have been incorporated, the desired mixed-carbide layer is formed on the surface of the ferrous alloy article. At that time, electrolysis may be applied at a sufficiently low electric-current density to avoid formation of a borate layer.

When the bath temperature is less than 850° C., the viscosity of the treating bath becomes too high to form a uniform mixed-carbide layer on the ferrous alloy article. On the other hand, when the temperature is more than 1100° C., the effectiveness of the treating bath and the quality of the treated article are impaired; the grain of the base material grows, and the toughness thereof is reduced.

The immersing treatment is effectively carried out in either an oxygen-free atmosphere or a normal atmosphere.

The present invention is illustrated by the following examples, which are not in any way intended to limit the scope of the invention. For example, the specified bath in each example is optionally replaced, in turn, by each of baths 1 to 30of Table I, the bath temperature is optionally decreased to, e.g., 900° C. or increased to, e.g., 1050° C., and the specified carbon-steel test pieces are optionally replaced by another ferrous-alloy article containing at least 0.10 percent by weight of carbon to obtain corresponding results. Likewise, boric acid or some other borate optionally replaces those illustrated.

EXAMPLE 1

A series of molten treating baths was prepared. Each treating bath was formulated with 5 kilograms (kg) of dehydrated borax, into which varying amounts of ferro-vanadium (50 weight percent of V) powder (−100 mesh) and/or of $Cr_2O_3$ powder (−100 mesh) were incorporated to produce molten treating baths wherein the ferro-vanadium (Fe-V) content (based on borax plus Fe-V plus $Cr_2O_3$) was 0, 3, 5, 10, 20 and 30 percent by weight and wherein the $Cr_2O_3$ content (on the same basis) was also 0, 3, 5, 10, 20 and 30 percent by weight, respectively. Twenty-seven treating baths with different combinations of Fe-V and $Cr_2O_3$ were thus prepared. Those with no vanadium had 0.16 kg (3%), 0.27 kg (5%), 0.55 kg (10%), 1.25 kg (20%) and 2.14 Kg (30%) of $Cr_2O_3$. Those with no $Cr_2O_3$ had 0.16 kg (1.5% V), 0.27 kg (2.5% V), 0.55 kg (5% V), 1.25 kg (10% V) and 2.14 kg (15% V) of Fe-V. The remaining baths with 5 weight percent of Fe-V had 0.275, 0.275, 0.297, 0.334 and 0.384 kg of Fe-V for 0.165 (3%), 0.275 (5%), 0.593 (10%), 1.336 (20%) and 2.306 (30%) of $Cr_2O_3$, respectively; those with 10 weight percent of Fe-V had 0.577, 0.593, 0.625, 0.713 and 0.835 kg of Fe-V for 0.173 (3%), 0.297 (5%), 0.625 (10%), 1.427 (20%) and 2.505 (30%) of $Cr_2O_3$, respectively; those with 20 weight percent of Fe-V had 1.304, 1.336, 1.427, 1.67 and 2.0 kg of Fe-V for 0.196 (3%), 0.334 (5%), 0.713 (10%), 1.67 (20%) and 3.0 (30%) of $Cr_2O_3$, respectively; and those with 30 weight percent of Fe-V had 2.24 and 2.306 kg of Fe-V for 0.22 (3%) and 0.384 (5%) of $Cr_2O_3$, respectively.

For each treating bath borax was first introduced into a heat-resistant-alloy crucible and melted by heating the crucible to 950° C. in an electric furnace. Thereafter, the indicated amounts of ferro-vanadium powder and- /or of $Cr_2O_3$ powder were charged into the molten borax to prepare the twenty-seven treating baths. Separate test pieces made of carbon tool steel (JIS SK4), having a length of 50 mm and a diameter of 8 mm, were dipped in each bath and kept therein for 4 hours at 950° C. After being removed from their respective baths and cooled in air, the test pieces were washed with water.

Figure 2:
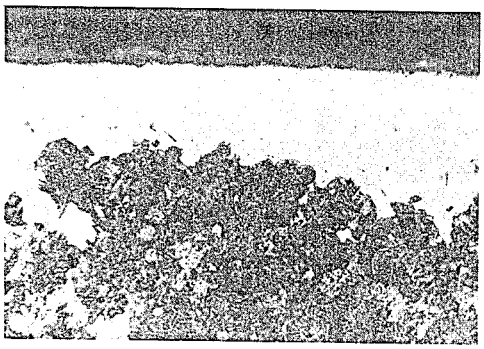
FIG. 2 shows a photomicrograph of the cross-section of a test piece treated in Example 1.

These test pieces were then cut to observe the results of the several treatments; the cross-sections were examined by microscope, X-ray microanalyzer and X-ray diffraction meter. The observed results are shown in FIG. 1, where the abscissa represents the weight percent of ferro-vanadium powder which was compounded in the treating-bath composition and the ordinate represents the weight percent of $Cr_2O_3$ powder which was compounded in the treating bath composition. A mark X in FIG. 1 indicates that no surface layer was formed; a mark ● indicates that a surface layer (observed by microscope) was formed in one layer and was composed mainly of vanadium carbide (VC); and a mark ○ indicates that a surface layer (observed by microscope) was formed in one layer and was composed mainly of chromium carbide ($Cr_7C_3$) and a little vanadium. Marks ◕, ◑ and ◔ indicate that the surface layer was formed in two layers, one of which abounded in vanadium (VC) whereas the other abounded in chromium ($Cr_7C_3$). For increasing amounts of chromium the marks are in the order of ◕, ◑ and ◔. A little vanadium was mixed in the layer abounding in chromium, and a little chromium was mixed in the layer abounding in vanadium; these layers were thus not pure chromium carbide and not pure vanadium carbide, respectively. Each thickness of a whole layer was from about 10 to about 12 microns, despite the composition of the treating bath. For example, a photomicrograph of the cross-section of the test piece treated in the bath composed of 10 percent by weight of ferro-vanadium, 10 percent by weight of $Cr_2O_3$ and the rest borax is shown by FIG. 2. In this photomicrograph, the layer composed of strips (of a white part and gray parts) running lengthwise is the carbide layer produced by this example. The white parts of this layer are the carbide abounding in chromium, and the gray parts are the carbide abounding in vanadium.

EXAMPLE 2

A second series of molten treating baths similar to that of Example 1 was prepared. Each of these was likewise formulated with 5 kg of dehydrated borax. However, vanadium was charged into this series of baths in the form of chips (thin plates having a 5 mm diameter) of $V_2O_5$, and chromium was charged in the form of metallic chromium powder. The weight percentages (based on total final treating bath weight) and actual amounts (in kg) for each of the two additives for twenty-eight treating baths are presented in Table II.

TABLE II

| | ADDITIONS TO MOLTEN BORAX (kilograms) | | | | | |
|---|---|---|---|---|---|---|
| $V_2O_5$, % | 0 | 3 | 5 | 10 | 20 | 30 |
| Cr, % | | | | | | |
| 0 | | | | 0.55 / | 1.25 / | 2.14 / |
| 3 | / 0.16 | | | 0.577 / 0.173 | 1.304 / 0.196 | 2.24 / 0.22 |
| 5 | / 0.27 | 0.165 / 0.275 | 0.275 / 0.275 | 0.593 / 0.297 | 1.336 / 0.334 | 2.306 / 0.384 |
| 10 | / 0.55 | 0.173 / 0.577 | 0.297 / 0.593 | 0.625 / 0.625 | 1.427 / 0.713 | 2.502 / 0.834 |
| 20 | / 1.25 | 0.196 / 1.304 | 0.334 / 1.336 | 0.713 / 1.427 | 1.67 / 1.67 | 3.0 / 2.0 |
| 30 | / 2.14 | 0.22 / 2.24 | 0.384 / 2.306 | | | |

Test pieces of carbon tool steel and the same as those of Example 1 were correspondingly treated in each of these baths, respectively, and the results were similarly observed. The different treating baths and the results are reflected by FIG. 3, in which the abscissa represents the weight percent of metallic chromium powder which was charged into the molten borax of the treating bath, and the ordinate represents the weight percent of $V_2O_5$ chips which was also charged into the molten borax of the treating bath.

Figure 3:
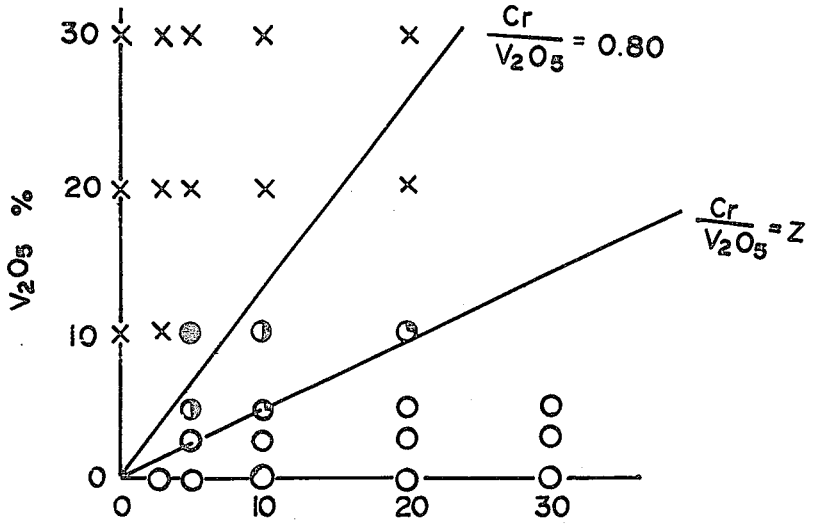
FIG. 3 shows the relation between the composition of the treating bath and the formed carbide surface layer according to Example 2.

Marks X, ●, ○, ◔, ◑ in FIG. 3 have meanings corresponding to those of the same marks in FIG. 1. The thickness of each whole layer was from 10 to 12 microns.

EXAMPLE 3

Figure 4:
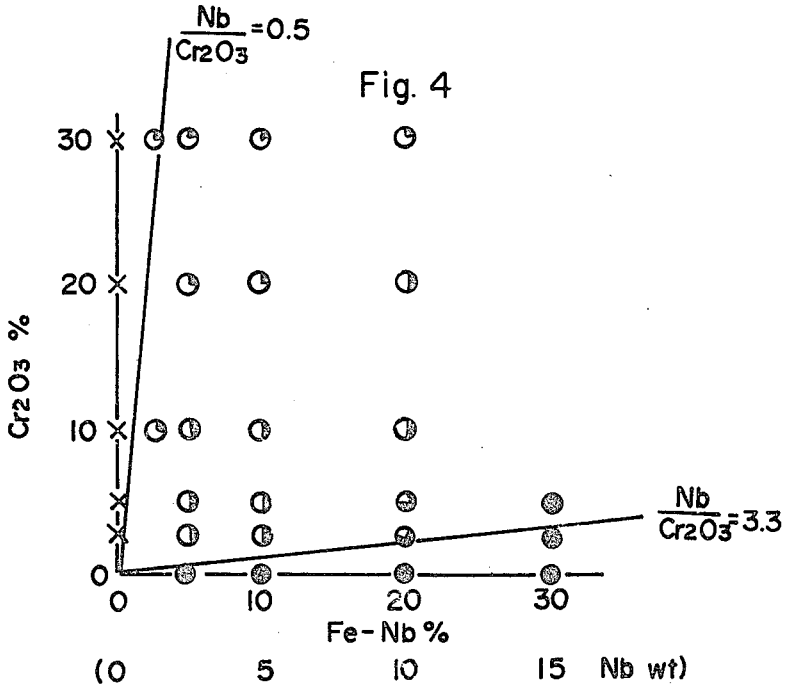
FIG. 4 shows the relation between the composition of the treating bath and the formed carbide surface layer according to Example 3.

For this Example dehydrated borax, $Cr_2O_3$ powder (−100 mesh) and ferro-niobium powder (−100 mesh, including about 50% of Nb) were used, and twenty-eight different treating baths, similar to those of Example 1, were prepared. The actual percentages of additaments incorporated in the molten borax treating bath are indicated in FIG. 4. Test pieces made of the same carbon tool steel and of the same size as those of Example 1 were similarly treated in each of these baths, and the results were observed.

In FIG. 4 the abscissa represents the weight percent of ferro-niobium powder which was charged into the molten borax of the treating bath, and the ordinate reflects the weight percent of $Cr_2O_3$ powder which was charged into the molten borax of the treating bath. A mark X in FIG. 4 indicates that no surface layer was formed; a mark ● indicates that a surface layer (observed by microscope) was formed in one layer and composed mainly of niobium carbide (NbC); a mark ◕ indicates a surface layer consisting of two layers, an upper part layer being a relatively thick strip composed mainly of niobium carbide and a lower part layer being a relatively thin strip composed of chromium carbide ($Cr_7C_3$); and a mark ◑ indicates a surface layer consisting of an upper part layer composed mainly of niobium carbide and a lower part layer composed mainly of chromium carbide, the boundary between two layers being like the teeth of a saw. A mark ◔ indicates a surface layer composed mainly of chromium carbide and in which insular parts composed mainly of niobium carbide are scattered. The thickness of each whole layer is from about 10 to about 12 microns irrespective of the composition of the treating bath.

EXAMPLE 4

For this Example dehydrated borax, $Nb_2O_5$ powder (−100 mesh) and metallic chromium powder (−100 mesh) were used, and twenty-five different treating baths were prepared similar to those of Example 2. The actual percentages of additaments incorporated in the molten borax are indicated in FIG. 5. Test pieces of the same carbide tool steel and of the same size as those in Example 1 were similarly treated in each of these baths, and the results were observed.

In FIG. 5 the abscissa represents the weight percent of metallic chromium powder which was charged into the molten borax of the treating bath, and the ordinate represents the weight percent of $Nb_2O_5$ powder which was also charged into the molten borax of the treating bath. Marks ╳, ○, ◔, ◑, ⊕ in FIG. 5 have meanings similar to those of corresponding marks in preceding examples.

The thickness of the whole carbide layer obtained according to this Example was from about 10 to about 12 microns. For example, the microphotograph of a cross-section of the test piece which was treated in the bath composed of 10 percent of metallic chromium powder, 10 percent of $Nb_2O_5$ powder and the rest borax is shown in FIG. 6. This photograph confirms that the surface layer consists of two parts. The upper part is a relatively thick strip composed mainly of niobium carbide, and the lower part is a relatively thin strip composed mainly of chromium carbide.

EXAMPLE 5

Figure 7:
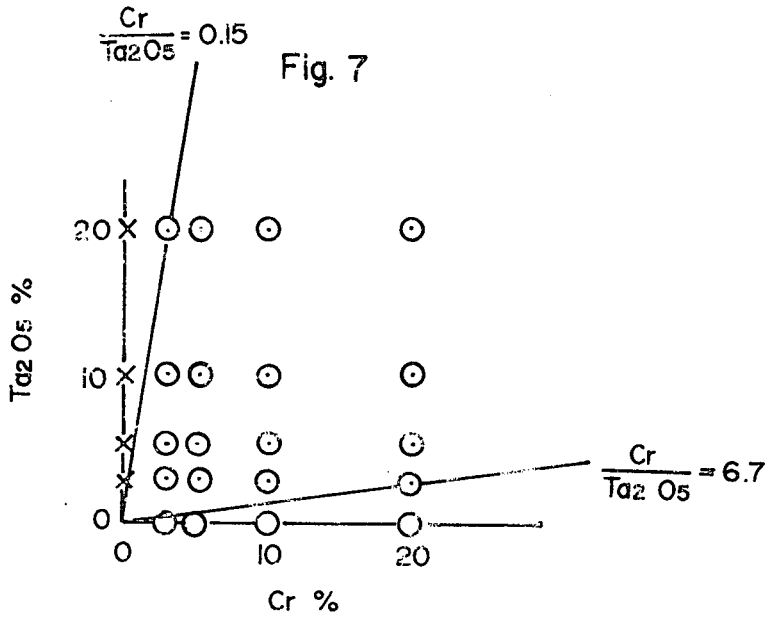
FIG. 7 shows the relation between the composition of the treating bath and the formed carbide surface layer according to Example 5.

For this Example dehydrated borax, $Ta_2O_5$ powder (−100 mesh) and metallic chromium powder (−100 mesh) were used, and twenty-four different treating baths were prepared similar to those of Example 2. The actual percentages of additaments incorporated in the molten borax treating baths are indicated in FIG. 7. Test pieces of the same carbide tool steel and of the same size as those of Example 1 were similarly treated in each of these baths, and the results were observed.

In FIG. 7 the abscissa represents the weight percent of metallic chromium powder which was charged into the molten borax of the treating bath and the ordinate represents the weight percent of $Ta_2O_5$ powder which was also charged into the molten borax of the treating bath. A mark ○ in FIG. 7 indicates the formation of one surface layer composed mainly of chromium carbide and excluding tantalum. A mark ⊙ indicates a surface layer composed mainly of chromium carbide but including tantalum carbide; from microscopic examination it seems that the surface layer is only one layer. The layer composed mainly of chromium carbide but including tantalum carbide has from 2 to 15 atom percent of tantalum and from 85 to 98 atom percent of chromium.

The thickness of the carbide surface layer formed by this Example was from 6 to 12 microns. Excluding those instances wherein the treating bath contained 3 percent of $Ta_2O_5$ powder or more than 10 percent of metallic chromium powder, the thicknesses of the surface layer were from 6 to 8 microns.

In the preparation of molten treating baths from combinations of components, it has been described that the borax and/or borate is first heated to bath temperature in a suitable crucible in, e.g., an electric furnace and each element (in metal or alloy form) and each oxide are introduced into the thus-obtained molten borate. However, in order to prepare the molten treating bath, other similar methods can be used. For example, firstly all the components are mixed up and then the mixture is heated up to the molten state. Also, molten treating bath can be changed to the treating material. Namely the bath is cooled to a solid state and then the solid is pulverized. The resulting powder can be used as the treating material.

The preceding text amply teaches those having any familiarity with the present art how to practice the described invention to the fullest extent. Numerous apparent variations are readily made without departing from the spirit or scope of the present disclosure.

What is claimed is:

1. A treating material having as sole initial essential constituent ingredients:
   - I. a member selected from the group consisting of boric acid and a borate and
   - II. a combination selected from the group consisting of:
     - A. a chromium oxide and at least one Va-Group element in metal or alloy form and
     - B. chromium in metal or alloy form and at least one Va-Group element in oxide form.

2. A treating material according to claim 1 which is a molten treating bath in which the member selected from the group consisting of boric acid and a borate is initially in molten form.

3. A molten treating bath according to claim 2 which is at a temperature within the range of from 850° to 1100° C.

4. A treating material according to claim 3 wherein the oxide and metal or alloy are initially in powder or flake form.

5. A treating material according to claim 4 wherein the amount of oxide and the amount of metal or alloy are in the range of from 1 percent to 40 percent of the weight of the molten treating bath.

6. A treating material according to claim 5 wherein member I comprises at least one molten borate selected from the group consisting of sodium borate, potassium borate, lithium borate and calcium borate.

7. A treating material according to claim 5 in which the combination is a chromium oxide and at least one Va-Group element in metal or alloy form.

8. A treating material according to claim 7 wherein the Va-Group element is in metal form and is a member selected from the group consisting of vanadium, niobium and tantalum.

9. A treating material according to claim 7 wherein the Va-Group element is in the form of an alloy selected from the group consisting of ferro-vanadium, ferro-niobium and ferro-tantalum.

10. A treating material according to claim 7 having a (Va-Group element)/(chromium oxide) weight ratio in the range of from 0.16 to 3.3.

11. A treating material according to claim 10 wherein the Va-Group element is in alloy form, the alloy is ferro-vanadium, and the weight ratio of vanadium in the ferro-vanadium to chromium oxide is in the range of from 0.16 to 2.

12. A treating material according to claim 10 wherein the Va-Group element is in alloy form, the alloy is ferro-niobium and the weight ratio of niobium in the ferro-niobium to chromium oxide is in the range of from 0.5 to 3.3.

13. A treating material according to claim 5 in which the combination is chromium in metal or alloy form and at least one Va-Group element in oxide form.

14. A treating material according to claim 13 wherein the oxide is at least one member selected from the group consisting of vanadium oxide, niobium oxide and tantalum oxide.

15. A treating material according to claim 13 wherein the chromium/oxide weight ratio is in the range of from 0.15 to 6.7.

16. A treating material according to claim 15 wherein chromium is in metal form, the oxide is vanadium oxide, and the weight ratio of chromium to vanadium oxide is in the range of from 0.80 to 2.

17. A treating material according to claim 15 wherein chromium is in metal form and the oxide is niobium oxide, and the weight ratio of chromium to niobium oxide is in the range of from 0.15 to 6.7.

18. A treating material according to claim 15 wherein chromium is in metal form and the oxide is tantalum oxide, and the weight ratio of chromium to tantalum oxide is in the range of from 0.15 to 6.7.

19. A composition suitable (without electrolysis or an unspecified reducing agent) for forming a mixed carbide layer on an article of a carbon-containing ferrous alloy, the composition having as initial constituent ingredients:

I. a member selected from the group consisting of boric acid and a borate and

II. a combination selected from the group consisting of:

A. a chromium oxide and at least one Va-Group element in metal or alloy form and B. chromium in metal or alloy form and at least one Va-Group element in oxide form.

20. A method of preparing a treating material according to claim 2 which comprises:

I. heating to its molten state at least one member selected from the group consisting of boric acid and a borate to form a molten bath, and II. introducing into the molten bath a combination selected from the group consisting of:

A. a chromium oxide and at least one Va-Group element in metal or alloy form and B. chromium in metal or alloy form and at least one Va-Group element in oxide form.

21. A method according to claim 20 which comprises introducing the oxide and metal or alloy into the molten bath in powder or flake form.

22. A method for forming a mixed carbide layer of one or more Va-group elements of the Periodic Table and chromium on an article of a carbon-containing ferrous alloy which comprises:

I. immersing the article into a treating material according to claim 3;

II. maintaining said article in the treating material to form a mixed carbide layer of at least one Va-group element and chromium on the surface of the article; and III. removing said article from said treating material.

23. A nonelectrolytic method according to claim 22.

24. A method according to claim 22 wherein the amount of oxide and of metal or alloy is in the range of from 1 percent to 40 percent of the weight of the molten treating bath.

25. A method according to claim 22 wherein said carbon-containing ferrous alloy is a member selected from the group consisting of carbon steel and alloy steel containing at least 0.1 percent by weight of carbon.

26. A method according to claim 22 wherein the molten treating bath comprises at least one borate selected from the group consisting of sodium borate and potassium borate.

27. A method according to claim 22 wherein the combination in the treating material is a chromium oxide and at least one Va-Group element in metal or alloy form.

28. A method according to claim 27 wherein the Va-Group element is in metal form and is a member selected from the group consisting of vanadium, niobium and tantalum.

29. A method according to claim 27 wherein the Va-Group element is in the form of an alloy selected from the group consisting of ferro-vanadium, ferro-niobium and ferro-tantalum.

30. A method according to claim 27 wherein the weight ratio of Va-group element in metal or alloy form to chromium oxide is in the range of from 0.16 to 3.3.

31. A method according to claim 30 wherein the Va-Group element is in the alloy form, the alloy is ferro-vanadium, and the weight ratio of vanadium in the ferro-vanadium to chromium oxide is in the range of from 0.16 to 2.

32. A method according to claim 30 wherein the Va-Group element is in alloy form, the alloy is ferro-niobium and the weight ratio of niobium in the ferro-niobium to chromium oxide is in the range of from 0.5 to 3.3.

33. A method according to claim 22 wherein the combination in the treating material is chromium in metal or alloy form and at least one Va-Group element in oxide form.

34. A method according to claim 33 wherein the oxide is at least one member selected from the group consisting of a vanadium oxide, a niobium oxide and a tantalum oxide.

35. A method according to claim 33 wherein the weight ratio of chromium in metal or alloy form to Va-Group element oxide is in the range of from 0.15 to 6.7.

36. A method according to claim 35 wherein chromium is in metal form, the oxide is vanadium oxide, and the weight ratio of chromium to vanadium oxide is in the range of from 0.80 to 2.

37. A method according to claim 35 wherein chromium is in metal form and the oxide is niobium oxide, and the weight ratio of chromium to niobium oxide is in the range of from 0.15 to 6.7.

38. A method according to claim 35 wherein chromium is in metal form and the oxide is tantalum oxide, and the weight ratio of chromium to tantalum oxide is in the range of from 0.15 to 6.7.

* * * * *

UNITED STATES PATENT AND TRADEMARK OFFICE

CERTIFICATE OF CORRECTION

PATENT NO. : 4,230,751

DATED : October 28, 1980

INVENTOR(S) : Noboru KOMATSU, Tohru ARAI and Hironori FUJITA

It is certified that error appears in the above-identified patent and that said Letters Patent are hereby corrected as shown below:

Title page, item [73] should read --Assignee: Kabushiki Kaisha Toyota Chuo Kenkyusho, Nagoya, Japan--.

Signed and Sealed this

*Eleventh* Day of *August 1981*

[SEAL]

*Attest:*

GERALD J. MOSSINGHOFF

*Attesting Officer*

*Commissioner of Patents and Trademarks*